US005811152A

United States Patent [19]

Cleary

[11] Patent Number: 5,811,152

[45] Date of Patent: Sep. 22, 1998

[54] METHOD OF IDENTIFYING A SURFACE

[75] Inventor: Michael Cleary, Thurstaston, United Kingdom

[73] Assignee: Smartwater Limited, Walsall, England

[21] Appl. No.: 762,834

[22] Filed: Dec. 10, 1996

Related U.S. Application Data

[63] Continuation-in-part of Ser. No. 211,245, Mar. 30, 1994, Pat. No. 5,605,650.

[30] Foreign Application Priority Data

Oct. 2, 1991 [WO] WIPO ..... PCT/GB91/01697

[51] Int. Cl.[6] ..... G08B 15/00; G08B 15/02; G09F 3/00

[52] U.S. Cl. ..... 427/8; 417/7; 417/157; 106/31.01; 252/301.25; 252/301.16

[58] Field of Search ..... 252/965, 301.16, 252/301.35; 427/7, 157, 8; 106/21 A, 22 B, 20 B, 19 R

[56] References Cited

U.S. PATENT DOCUMENTS

| | | | |
|---|---|---|---|
| 3,666,680 | 5/1972 | Briggs | 252/316 |
| 3,861,886 | 1/1975 | Meloy | 252/965 |
| 3,960,755 | 6/1976 | Beachem et al. | 106/21 A |
| 4,015,131 | 3/1977 | McDonough et al. | 106/21 A |
| 4,131,064 | 12/1978 | Ryan et al. | 252/965 |
| 4,197,104 | 4/1980 | Krystyniak et al. | 252/965 |
| 4,399,226 | 8/1983 | Danielson et al. | 252/965 |
| 4,441,943 | 4/1984 | Kydd | 252/965 |
| 4,610,806 | 9/1986 | Rosen | 106/22 B |
| 5,084,097 | 1/1992 | McCreary et al. | 106/19 R |
| 5,599,578 | 2/1997 | Butland | 427/7 |
| 5,605,650 | 2/1997 | Cleary | 252/301.35 |

*Primary Examiner*—Melissa Bonner
*Attorney, Agent, or Firm*—Dennison, Meserole, Pollack & Scheiner

[57] ABSTRACT

A method for identifying a surface in which a plurality of trace material is used to establish a database in which a unique combination of trace materials is assigned to a unique source. A composition is formulated containing the unique combination together with an indicator material and a solvent system, the solvent system including a solvent which is volatile under conditions of application. This composition is applied to a surface and the solvent permitted to evaporate, after which the composition is detected on the basis of the indicator material and each of the plurality of trace materials is identified. The unique source can then be determined from the database.

17 Claims, No Drawings

METHOD OF IDENTIFYING A SURFACE

The present application is a continuation-in-part of U.S. patent application Ser. No. 08/211,245, filed Mar. 30, 1994, now U.S. Pat. No. 5,605,650.

BACKGROUND OF THE INVENTION

The present invention concerns improvements in or relating to the security of articles, goods, vehicles or premises. More particularly, the present invention provides a composition and method for the prevention of those acts listed hereunder utilizing a combination of deterrence and also identification of those involved in:

a) Unauthorized removal of articles or goods including cash from vehicles, buildings and/or premises;

b) Vandalism of articles, goods, buildings and/or premises;

c) Unauthorized entry into restricted areas;

d) Acts, possibly violent, by groups, against state, military, police or public property or personnel;

e) Counterfeiting of goods.

In addition, the invention can be used as a means for tracking goods within an organization, or in the stream of commerce.

Unauthorized removal or stealing of articles or goods is an increasing problem. A recent survey has shown that the stealing of articles or goods is predominantly based on opportunism. Such survey showed that unauthorized removal of articles or goods was carried out in a ratio of opportunists to hardened criminals of 80%:20%.

One situation in which unauthorized removal of articles or goods has taken place is in buildings such as parcel distribution centers, warehouses, storage depots, department stores and the like. In such locations, articles or goods, suitably in the form of parcels, are constantly transported throughout the building. During such transportation, certain parcels may be stolen, and it is often difficult to catch the thief, particularly when there are a large number of employees operating in the building concerned. In addition to pilfering of articles or goods, in certain circumstances vandalism has been a problem, with the articles or goods not having been stolen but, rather, damaged instead.

Another situation in which unauthorized removal of articles or goods has taken place is in connection with theft of articles or goods from premises or vehicles. Such unauthorized removal is an increasing problem and it is often difficult for authorities to convict a thief or burglar since it not always possible to prove that the thief or burglar was present at a particular robbery.

Various types of chemicals have been considered for application to the surface of an article, goods or premises. A composition utilizing a dyestuff has been proposed, but was not considered appropriate since the dye can be seen on the article, goods or premises. Another prior arrangement relates to the use of a fluorescent material dispersed in a carrier. The solid fluorescent material is dispersed in a grease and is then smeared onto surfaces or articles liable to unwanted attention. The disadvantages of such arrangement is that the material when applied is greasy or slippery to the touch, and also has a granular feel because of undissolved particles present therein.

SUMMARY OF THE INVENTION

Accordingly, the present invention is based on the provision of a composition and method whereby, the composition applied to a surface and can later be identified as to source with a high degree of certainty.

It is an object of the present invention to provide a composition and method for reducing unauthorized removal of, or damage to, articles or goods and for preventing damage to property.

It is a further object of the present invention to provide a composition and method whereby, when the composition has been applied to a surface, any person who touches the surface can be identified.

It is a still further object of the invention to provide a composition and method for use in buildings and/or premises or with vehicles which can be utilized in a sprinkler or like spray system, for identifying the thief or burglar.

DETAILED DESCRIPTION OF THE INVENTION

According to the present invention there is provided a composition for preventing unauthorized removal of or damage to articles or goods from vehicles, buildings and/or premises or for preventing damage to premises, or for tracking goods. The compositions comprise a solvent medium containing a volatile component, together with a plurality of trace materials which can be varied in such a manner as to produce unique formulations, the combinations of trace materials being varied by modeling the compositions on binary strings to produce large numbers of unique products. The term "trace materials" applies herein to materials which would not normally be present in the environment of use. The most commonly used trace materials are metal compounds, although organic moieties which are stable under conditions of use are also useful, since organic moieties can be identified by a variety of spectral and chromatographic means. Examples of useful organic trace materials are 1,2,3,4-tetrahydrocarbazole and 2,6-methoxybenzonitrile.

Preferably, the compositions also contain an indicator material, which can quickly provide a preliminary, gross indication of the presence of a composition according to the invention. The indicator material can either be "overt" or "covert." An overt material is typically one which can be seen unaided by technology, such as a dye or pigment. With an overt indicator, the fact of an application and the area of application are immediately evident from an observation of the article or person.

A covert indicator will remain hidden until some technical means is used to make it obvious. Usually, a covert indicator will become visible upon application of a radiation means other than visible light, and of these, fluorescent indicators are most common. Thus, the covert indicator will often be at least one fluorescent material which is soluble in the solvent system, and which is easily detectable upon examination with ultraviolet light. Conceivably, a low level radioactive material could also be used, as well as any other material which would easily provide a gross indication that the composition is present upon a quick examination.

Trace materials can thereby be combined in a way which gives good evidential value to law enforcement agencies, as each unique formulation is allocated to a particular premises, location or person, and this information is stored in a central database which can be accessed by a law enforcement agency receiving the report of a laboratory analyzing the mixtures which are to be discussed.

The trace materials are assigned constant positions in a binary string with their presence is given by a "1", and their absence by a "0". If, for example, one were to set a limit of thirty digits for the string, one could begin with combinations of two trace materials, and generate all combinations containing any two trace materials. One could then go to groups of three trace materials, and generate all combinations of any three trace materials. This could continue until the number of trace materials is equal to the number of digits in the string.

With a thirty digit string, the total number of unique combinations of trace materials is approximately one billion. Thus, it is possible to prepare one billion mixtures having compositions based on unique binary sequences, the compositions thereby being unique.

Binary strings are provided as exemplary of the identification schemes which can be used. Strings of other lengths, such as octal and hexadecimal strings, can also be used.

The unique nature of each composition can be found from sampling the product after application and subjecting the sample to chemical analysis. The composition can then be stored in a database, allocated to a premises, location, or person, and the source of goods located at a later time can be traced to the premises, location or person via the composition.

Of course, the greater the number of trace materials used, the greater the certainty in identification later on, since the chance presence of trace materials can be ruled out. In practice, at least five trace materials will preferably be used in combination to provide a high degree of certainty in identification, although fewer materials may be used, especially when court proceedings are not involved.

A method is thus provided that can produce formulations which can be varied uniquely through the systematic combination of trace materials by modeling their composition on binary strings, thereby producing large numbers of unique products. The use of a database then allows true ownership of stolen goods to be determined on a worldwide basis.

In use, the composition of the invention is applied to at least a portion of the surface of such articles or goods, or to a container therefor, or at least a portion of a property or surrounding area. Thus, the source of stolen goods can be positively identified. Further, if the composition of the invention is transferred to the person involved in the theft or damage, the person can also be positively identified, first by the use of the gross indicator means, such as with a UV-light examination, then by more sophisticated trace material analysis means.

Also, according to the present invention, there is provided a method for preventing unauthorized removal of or damage to articles or goods from vehicles, buildings and/or premises, or for preventing damage to premises, comprising applying to at least a portion of the surface of the articles or goods, or at least a portion of a property or surrounding area, or storing ready for application to said surfaces, a composition according to the invention, whereby when the articles or goods have been stolen or damaged, or the property damaged, the fluorescent material contained in such composition is transferred to the person involved, which person can then be identified by the use of the gross indicator means.

When the gross indicator means is fluorescent, the composition can include one or more of any suitable fluorescent materials. However, it has been found that coumarin, oxazinone, and stilbene derivatives are preferred, but fluorescein derivatives can also be utilized.

It is possible to utilize coumarin derivatives, preferably 7-hydroxy-4-methyl coumarin or 7-diethylamino-4-methyl coumarin. Fluorescein derivatives, preferably sodium fluorescein are also usable.

It is possible to utilize a fluorescent material which when exposed to UV light fluoresces in a particular color, each particular fluorescent material being selected for a particular customer, so that when the composition containing the selected fluorescent material is applied to a surface of articles or goods, then any unauthorized removal of such articles or goods can be linked back to the particular customer as the source of goods. This is of use when a thief or burglar is apprehended and the fluorescent material which was transferred to the thief or burglar is identified by the use of UV-light, thereby linking the thief or burglar with a particular location.

It is further possible to utilize a combination of two fluorescent materials having differing max absorption or emission frequencies. It is possible to identify the two materials by utilizing a UV-absorption spectrum or a fluorescent emission spectrum. Accordingly, such combination of fluorescent materials, when applied to a surface of articles or goods and when transferred to a thief or burglar, can positively link the thief or burglar with a particular location, with no chance of a pleading by the thief or burglar that he had picked up or touched fluorescent material accidentally or innocently.

The fluorescent material is preferably utilized in spray form and can be combined with various solvent systems and surfactants. The fluorescent material is suitably present in an amount of 0.1 to 40% by weight of the composition.

The composition preferably contains one or more carrier materials, such as a polymer material which forms a film upon drying. The preferred polymers for this purpose are polymethyl methacrylate and polystyrenebutadiene, supplied in aqueous emulsion form. For spray application, the polymer concentration will be fairly low, around 3–10 grams of emulsion in 100 ml diluent, which compositions to be painted onto articles can contain much higher concentrations of polymer, preferably 60–80 grams in 100 ml diluent.

Another carrier material which can be used comprises microsponges which absorb the trace materials, and which can be suspended in a polymer emulsion carrier.

The solvent medium preferably comprises a mixture of a volatile solvent at ambient temperature or at the temperature of application and a non-volatile solvent at ambient temperature. The volatile solvent is preferably a low boiling alcohol, preferably isopropyl alcohol or t-butanol. The non-volatile solvent is preferably isopropyl myristate or glycerol trioleate.

In the case of an aerosol, the composition will also include a propellant, suitably butane and suitably one or more surfactants. The surfactant is preferably polyethylene glycol or polypropylene glycol.

A preferred composition for use in the invention comprises a mixture of a fluorescent material together with isopropyl alcohol as the volatile solvent and isopropyl myristate as the non-volatile solvent. When applied in spray form the isopropyl alcohol evaporates leaving a film of fluorescent material and isopropyl myristate applied to a selected surface.

It is believed that in a spray composition, such a combination of solvents may be effective in two ways. As the isopropyl alcohol evaporates the fluorescent material becomes supersaturated in the isopropyl myristate layer. Alternatively, as the isopropyl alcohol evaporates the fluorescent material comes out of solution in a mirocrystalline state due to the cooling effects of the evaporating isopropyl alcohol. In either event, a substantial amount of fluorescent material is present in a very thin layer which cannot be felt, seen or smelt.

Furthermore, when using isopropyl myristate, any discoloring or yellowing of the fluorescent material is prevented. Such yellowing is believed due to a photocyclodinerization reaction of the fluorescent material which is less pronounced in the low polarity long chain isopropyl myristate.

A preferred aerosol composition comprises 0.5 gm of fluorescent material, 2.5 gm of isopropyl myristate and 12 ml of isopropyl alcohol in a 150 ml aerosol can. This composition stays active on the material to which it is applied.

In a preferred embodiment, the composition applied is colorless, odorless and has no feel thereto, and is therefore undetectable; preferably the composition is capable of transfer from one surface to another.

In an embodiment of the invention, the composition is applied immediately prior to an article, such as a dummy parcel, passing through a particular section of a department store or warehouse. The composition is suitably in aerosol form and can be sprayed onto the dummy parcel. In such case, the composition applied to the dummy parcel would be undetectable by sight, touch or smell.

Should the dummy parcel be stolen or be damaged, the composition will be transferred to the culprit. Accordingly, the employees could be brought together and then the hands of each person in turn would be scanned by UV-light. The thief or vandal would have fluorescent material on his or her hands or clothing and could be so identified.

It can thus be seen that, by utilizing the composition and method of the present invention, a thief and/or vandal can be identified. The fluorescent material of the composition of the present invention will remain on the fingers of the thief or vandal after the article or goods have been removed and possibly hidden, whereas previously such would not have been the case.

The composition and method of the present invention can be applied in any situation wherein unauthorized removal of or damage to, an article may take place, for example, in the case of transport of goods by motor vehicle, train or airplane. In such situations, it is preferable to use the fluorescent material utilized in the composition of the invention in sprinkler systems employed in vehicles used for moving articles or goods and in premises for storing or displaying articles or goods.

When such sprinkler system is utilized in premises, the sprinkler system is operated by a burglar alarm and when activated, the articles or goods in such premises, in a store or on display are sprayed with the fluorescent material as would be any personnel involved in the burglary.

A similar sprinkler system could be utilized with vehicles, particularly road vehicles, and be activated by unauthorized entry into the vehicle.

The fluorescent material used in such sprinkler systems can be water based, either as a solution or as a suspension. The solutions preferably comprises fluorescein derivatives, coumarin derivatives or diamino stilbene disulphonic acid derivatives at a concentration of 0.1–20 wt % in the presence of a polymer latex. The suspensions preferably comprise an oxazinone derivative of 0.1–20 wt % concentration in aqueous suspension stabilized by anionic surfactants and in the presence of a polymer latex.

The polymer latex is chosen so that it becomes water insoluble on drying, possibly through some type of cross linking mechanism to which end a cross-linking agent may also be added. Trace materials may be used which would normally be water soluble but are held in place by the polymer matrix. Different polymers may also be used and identified subsequently and therefore also act as "trace materials". Polymer combinations may also be used and it can thus be seen that a vast range of permutations are available through varying the polymer and varying the trace materials.

The composition and method of the present invention would suitably be utilized accompanied by warning notices etc., to indicate to any potential thief and/or vandal that the person who removes a particular parcel can be identified.

Any suitable UV-light emitting means can be utilized in the present invention for the basic determination that an article or person has come into contact with a composition of the invention. Then, a sample can be taken from the article or person and subjected to analysis for trace materials. Among the qualitative analysis methods which can be used are X-ray fluorescence, inductively coupled plasma atomic emission spectroscopy, atomic absorption spectroscopy, high performance liquid chromatography, gas chromatography/mass spectroscopy, capillary electrophoresis, scanning electron microscopy and secondary ion mass spectroscopy.

While specific reference has been made to a thief and/or vandal, it is clear that the composition and method of the invention can also be used in identifying a person involved in certain criminal activities. Also, warning notices could also be provided to indicate to any potential criminal that crime prevention measures are in place and that the criminal may be identified.

EXAMPLE

Acetylacetonates of titanium, vanadium, chromium, manganese and cobalt were prepared, dissolved in methylene chloride. Each acetylacetonate was added to a suspension of microsponges and the solvent evaporated, leaving five lots of microsponges into which a single metal compound was absorbed. Each lot of microsponges was then added to a polymer emulsion containing 70 grams of aqueous 50 wt % polymethyl methacrylate emulsion and 100 ml diluent, the final emulsion containing 0.2 grams of each metal in 100 ml diluent. To this emulsion was added 0.2 grams/100 ml of Blankophor® BSUN, a fluorescent material, and a fungicide. The mixture was stirred thoroughly, coated onto a plastic sheet and dried.

The surface of the sheet was analyzed by X-ray fluorescence for the presence of five metals.

These five metals can be added to a polymer emulsion individually or can be added in any of 23 different combinations, for a total of 28 possibilities, each possibility being a unique identifier for a material on which the emulsion is coated.

The metals mentioned hereinabove are representative of the metals which can be used for the purposes of the invention, but this disclosure should not be considered limiting as many other metals can and will be used in combination to form unique identifiers for goods.

What is claimed is:

1. A method for identifying a surface, comprising the steps of:

selecting a plurality of trace materials, each said trace material corresponding to a compound of a different metal;

establishing a database in which a unique combination of at least three said metal compounds is assigned to a unique source;

formulating a composition containing said unique combination together with an indicator material and a solvent system therefor, said solvent system comprising a solvent which is volatile under conditions of application;

applying said composition to a surface, and permitting said solvent to evaporate, said composition after evaporation being colorless, odorless and having no feel thereto;

detecting said composition on the basis of said indicator material and identifying each of the plurality of metal compounds therein; and determining the unique source from said database.

2. A method according to claim 1, wherein said step of applying comprises applying to the surface said composition comprising at least five trace materials.

3. The method of claim 1, additionally comprising causing transfer of said composition to a person tampering with the surface after evaporation of the solvent by contact with the surface, and carrying out said detecting and identifying on the person.

4. The method of claim 1, wherein the indicator material is fluorescent, additionally comprising detecting the indicator material on the surface by UV-light, and identifying the trace materials in the composition to determine the source of the composition.

5. The method of claim 3, wherein the indicator material is a UV fluorescent activator material, additionally comprising detecting the indicator material on the person by UV-light, and identifying the trace materials in the composition to determine the source of the composition.

6. The method of claim 1, wherein:

said step of establishing a database comprises creating a binary string in which each specific position corresponds to a specific trace material, with the presence of a specific trace material indicated by a "1" in the specific position in the string, and the absence of a specific trace material indicated by a "0" in the specific position; and said step of selecting a plurality of trace materials comprises selecting trace materials corresponding to a particular value of said binary string.

7. The method of claim 6 wherein the indicator material is a UV-activated fluorescent material;

said detecting comprises detecting said composition on a surface or a person by UV-light;

said identifying comprises identifying the trace materials in the composition on the surface or person;

said determining comprises determining to which binary string the identified trace materials correspond; and said using comprises using the determined binary string to identify the source of the composition.

8. The method of claim 7, wherein said step of using the determined binary string is performed by comparing the determined binary string to a list of binary strings in the database.

9. The method of claim 1, wherein the trace materials are detected by a method selected from the group consisting of X-ray fluorescence, inductively coupled plasma atomic emission spectroscopy, atomic absorption spectroscopy, high performance liquid chromatography, gas chromatography/mass spectroscopy, capillary electrophoresis, scanning electron microscopy and secondary ion mass spectroscopy.

10. A method for identifying a surface, comprising the steps of:

selecting a plurality of separately identifiable trace materials;

establishing a database in which a unique combination of at least five said trace materials is assigned to a unique source;

formulating a composition containing said unique combination together with an indicator material and a solvent system therefor, said solvent system comprising a solvent which is volatile under conditions of application;

applying said composition to a surface, and permitting said solvent to evaporate, said composition after evaporation being colorless, odorless and having no feel thereto;

detecting said composition on the basis of said indicator material and identifying the plurality of trace materials therein; and determining the unique source from said database.

11. The method of claim 10, additionally comprising causing said transfer of said composition to a person tampering with the surface after evaporation of the solvent by contact with the surface, and carrying out said detecting and identifying on the person.

12. The method of claim 10, wherein the indicator material is fluorescent, additionally comprising detecting the indicator material on the surface by UV-light, and identifying the trace materials in the composition to determine the source of the composition.

13. The method of claim 11, wherein the indicator material is a UV-activated fluorescent material, additionally comprising detecting the indicator material on the person by UV-light, and identifying the trace materials in the composition to determine the source of the composition.

14. The method of claim 10, wherein:

said step of establishing a database comprises creating a binary string in which each specific position corresponds to a specific trace material, with the presence of a specific trace material indicated by a "1" in the specific position in the string, and the absence of a specific trace material indicated by a "0" in the specific position; and said step of selecting a plurality of trace materials comprises selecting trace materials corresponding to a particular value of said binary string.

15. The method of claim 14, wherein the indicator material is a UV-activated fluorescent material;

said detecting comprises detecting said composition on a surface or a person by UV-light;

said identifying comprises identifying the trace materials in the composition on the surface or person;

said determining comprises determining to which binary string the identified trace materials correspond; and said using comprises using the determined binary string to identify the source of the composition.

16. The method of claim 15, wherein said step of using the determined binary string is performed by comparing the determined binary string to a list of binary strings in the database.

17. The method of claim 10, wherein the trace materials are detected by a method selected from the group consisting of X-ray fluorescence, inductively coupled plasma atomic emission spectroscopy, atomic absorption spectroscopy, high performance liquid chromatography, gas chromatography/mass spectroscopy, capillary electrophoresis, scanning electron microscopy and secondary ion mass spectroscopy.

* * * * *